United States Patent [19]

Winkler et al.

[11] Patent Number: 4,510,184

[45] Date of Patent: Apr. 9, 1985

[54] PROCESS AND APPARATUS FOR BONDING PARTICULATE MATERIAL, IN PARTICULAR CHIPS

[75] Inventors: Hermann Winkler, Sassenburg; Hanns I. Sachs, Cologne, both of Fed. Rep. of Germany

[73] Assignee: Bayer Aktiengesellschaft, Leverkusen, Fed. Rep. of Germany

[21] Appl. No.: 436,132

[22] Filed: Oct. 22, 1982

[30] Foreign Application Priority Data

Nov. 5, 1981 [DE] Fed. Rep. of Germany ..... 3143895

[51] Int. Cl.[3] ..... B05D 7/00; B05B 17/00; B05C 5/00

[52] U.S. Cl. ..... 427/212; 118/303

[58] Field of Search ..... 427/212, 213, 424; 118/303

[56] References Cited

U.S. PATENT DOCUMENTS

| | | | |
|---|---|---|---|
| 2,707,690 | 5/1955 | Pearson | 427/424 |
| 3,386,182 | 6/1968 | Lippert | 118/303 X |
| 3,481,686 | 12/1969 | Ivnas et al. | 118/303 X |
| 3,548,782 | 12/1970 | Bergquist et al. | 118/303 X |

FOREIGN PATENT DOCUMENTS

| | | |
|---|---|---|
| 256433 | 8/1967 | Austria . |
| 271861 | 6/1969 | Austria . |
| 1048013 | 12/1958 | Fed. Rep. of Germany . |
| 1653223 | 9/1970 | Fed. Rep. of Germany . |
| 1632450 | 12/1970 | Fed. Rep. of Germany . |
| 2438818 | 2/1976 | Fed. Rep. of Germany . |
| 2304262 | 5/1978 | Fed. Rep. of Germany . |
| 2653683 | 6/1978 | Fed. Rep. of Germany . |
| 2711958 | 9/1978 | Fed. Rep. of Germany . |
| 2913081 | 11/1980 | Fed. Rep. of Germany . |
| 2228604 | 12/1974 | France . |
| 78881 | 1/1971 | German Democratic Rep. . |

OTHER PUBLICATIONS

Chemical Engineers Handbook Perry & Chilton-5th Ed. 1973 pp. 7-16, 7-21 and 20-55, 20-58.

*Primary Examiner*—Michael R. Lusignan
*Attorney, Agent, or Firm*—Gene Harsh; Joseph C. Gil

[57] ABSTRACT

For achieving optimum application of bonding agent to particulate material, in particular chips, without elaborate plant and machinery, it is proposed to carry out the application of bonding agent using a pneumatic conveyor device for material which is in any case present, by arranging at least one spray nozzle for bonding agent in at least one section of the pipes of the material transport device and spraying the particles which are transported in the form of a film, using this spray nozzle for bonding agent.

7 Claims, 2 Drawing Figures

PROCESS AND APPARATUS FOR BONDING PARTICULATE MATERIAL, IN PARTICULAR CHIPS

BACKGROUND OF THE INVENTION

The present invention relates to a process for bonding particulate material such as chips, wafers, strands, fibers, shavings or dust of various, optionally pre-dried, raw materials, such as size-reduced industrial waste and, in particular, materials containing lignocellulose, such as wood or annual plants, by spraying a bonding agent on the material which has been broken down into a layer of particles. The present invention also relates to an apparatus for carrying out the process, based on a known pneumatic apparatus for transporting material, comprising conveyor blowers, feed screw, pipelines, separators, compensating vessel and knife gate.

A process of the type indicated above has been disclosed in German Offenlegungsschrift No. 1,653,223, wherein a device designed to achieve fine sub-division is provided to produce a film of particles. The device is designed for processing fibrous material, such as wood fibers or fine wood dust in the form of short, fine, thin fibers. The apparatus for fine sub-division of the fibrous material consists essentially of a stationary screen cage or perforated wall and a stirrer arranged inside the cage. Connected to this device upstream thereof is a dosing device for the fibrous material. The stirrer in the device for fine sub-division is driven and has stirrer arms which push the fibrous material radially outwards through the perforations of the cage in superposed planes so that a film of particles is formed without the particles making contact with a wall and this film descends under free fall in the form of a hollow cylinder. This film of particles is bonded in two stages, once from the inside and once or more from the outside, by successively spraying bonding agent on to the particles of the film. The film of particles has a considerable thickness so that the jets of bonding agent sprayed from the inside to the outside of the film wet the film, to varying degrees and penetrate the film to varying depths. Application of the bonding agent from the inside is carried out without pressure, but application from the outside may be carried out under pressure. To counteract uneven application of bonding agent, agitator mixers are connected downstream of the apparatus. Alternatively, two wetting installations are provided in succession and the particles are passed through the two installations in succession. The investment in machinery for these specialized treatments is considerable.

For achieving more uniform bonding of the particles of a particle film, German Offenlegungsschrift No. 2,913,081 describes a process which may also be used for evenly applying bonding agent to flat wood chips of the type which are present in a wood chip board. This object is achieved by turning the film of wood chips between two stages of application of bonding agent, the bonding agent being applied predominantly to the front surface of the flat chips in the first stage and predominantly to the back of the flat chips in the second stage. A very thin film of particles is used in this process and again a considerable outlay in machinery is required.

German Offenlegungsschrift No. 2,653,683 discloses a process and an apparatus by which wood chips are formed into a ring which moves in a spiral while the chips are treated with bonding agent. The apparatus contains a high speed mixer shaft which produces the spirally moving ring of chips along the internal wall of the container. Centrifugal tubes dip with the outlet openings thereof for bonding agent into this ring of chips. These centrifugal tubes for the supply of bonding agent are distributed over the circumference and axis of the mixer shaft over the whole bonding and mixing zone. These centrifugal tubes serve not only to apply bonding agent to the chips, but also to exert a certain mixing action on the wood chips of the ring. The bonding agent leaves the ends of the tubes in the ring of chips in the form of droplets which are swept over the chips as the chips move past them. The bonding agent becomes uniformly distributed over the chips by the friction of the wood chips and the use of constantly changing relative velocities. In spite of the considerable length of the apparatus, homogeneous distribution is in fact not achieved, partly because the bonding agent in the form of droplets is transmitted in a highly concentrated form to individual chips.

A very similar apparatus is disclosed in German Auslegeschrift No. 2,304,262, but in this case the bonding agent is delivered through tubes in the wall of the mixer without application of pressure. The openings of the tubes are situated in the ring of chips. Here again, the chips remove the bonding agent in the form of droplets from the free end of each delivery tube and the bonding agent is transmitted to other wood chips by contact between chips and a wiping action.

These known types of apparatus also require the provision and operation of separate installations which entail additional expenditure.

Pneumatic chip transport devices comprising conveyor blowers, feed screws, pipelines, separators, compensating vessels and knife gates or the like are known, such devices serve to transport the chips, for example, from the place where they are produced to the place where they are to be processed. The known installations convey the chips in a loosened form together with a substantial proportion of transport air through the pipelines. The apparatus must be so designed that long transport paths may be traversed without the chips undergoing further size reduction or parts of the installation undergoing significant wear and tear.

Typical of such pneumatic conveyors are those described in the Chemical Engineers' Handbook, Perry and Chilton, Fifth Edition, 1973, pages 7-16 to 7-21 and 20-55 to 20-58.

DESCRIPTION OF THE INVENTION

Figure 1:
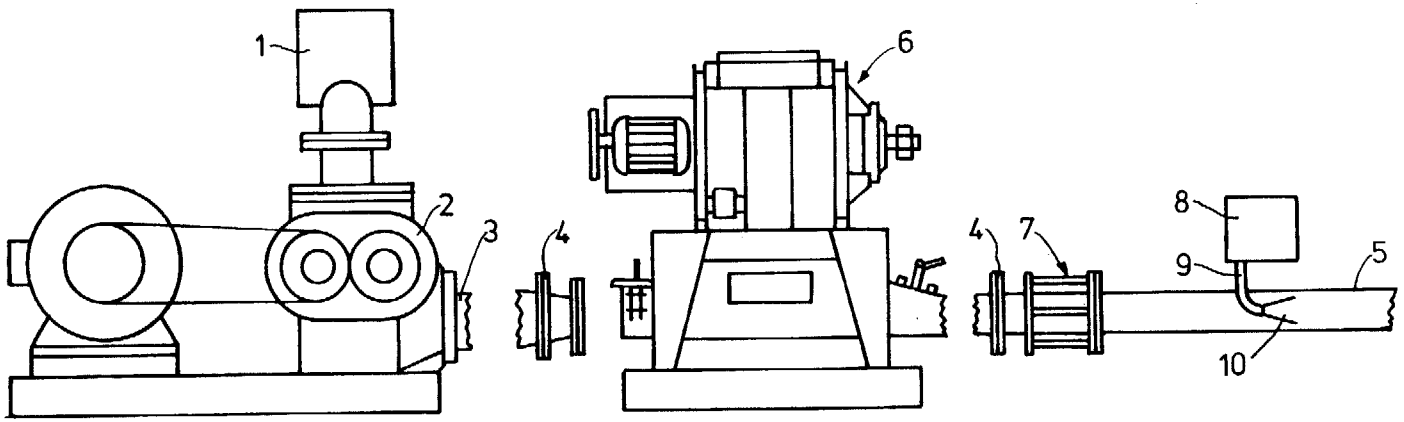
FIG. 1 is a schematic overall view of the apparatus of the present invention.

It is an object of the present invention to achieve optimum application of bonding agent to the material in the sense of achieving particularly homogeneous distribution of the bonding agent and at the same time keeping the expenditure in machinery relatively low.

To achieve this according to the present invention, the bonding agent is sprayed on the material while the material is being conveyed pneumatically. This has the important advantage that the pneumatic conveyor device which must in any case be present and in which the film of particles is formed may be used to serve a second function, namely that of application of the bonding agent. This obviates the use of an additional bonding installation and additional drive means for such bonding installation. Utilization of the pneumatic conveyor device for bonding the particles of material has the further advantage that hardly any wear and tear occurs. The pneumatic conveyor device requires very little servicing compared, for example, with a turbo mixer, nor do the particles suffer any change in size due to subsequent size reduction such as occurs in intensively operating bonding installations equipped with a mixer. (It is precisely in the latter type of installation, however, that a mixing zone is essential in order to achieve transmission of the bonding agent from one particle to another). Application of bonding agent during the pneumatic conveyance of material also prevents heating of the material such as is often observed in stirrer apparatus due to the energy of stirring introduced. The useful life of the bonded particles is thereby increased. Another advantage is that the pneumatic transport of chips for the purpose of bonding substantially obviates the need for cleaning which must be carried out in apparatus with mixers.

Spraying of the bonding agent may be carried out inside a pipe of the pneumatic conveyor device, which means that a pipe or pipeline already present may be used. It is not even necessary to change the diameter of the pipe. The bonding agent must, of course, by sprayed there, but this involves comparatively little expenditure.

It is particularly advantageous to employ a medium pressure system using an air pressure of from about 0.2 to 0.8 bar for the pneumatic conveyance of material. These medium pressure systems have the advantage of providing a relatively high density of material, i.e. the ratio of quantity of air to quantity of particles is advantageous. The bonding agent does not become too diluted. The film of particles takes up the bonding agent which is sprayed or atomized without risk of the internal wall of the pipe or pipeline being unduly wetted by the bonding agent, so that no build-up of bonding agent is liable to occur. It is advantageous if the density of material is such that approximately 150 liters of chips in a layer having a density of 100 kg/m$^3$ are conveyed in a cubic meter of air. For spraying the bonding agent in the pipe of the pneumatic conveyor device, a liquid pressure of about 200 bar may be suitable, but the pressure is not limited to this value. Two or more material nozzles subjected to air under pressure may also be used.

The application of bonding agent is suitably carried out by means of several nozzles spaced in succession inside the pipe.

The film of particles may be uniformly distributed in the pipe of the pneumatic conveyor by means of air conducting installations and may be diverted in front of the outlet apertures of the nozzles so that it is kept away from these apertures to enable the binder to disperse in the air before it is sprayed so that it may be more finely divided before it comes into contact with the particles.

If the bonding agent used is a polyisocyanate mixture of the diphenylmethane series (polymeric MDI) as described, for example, in German Auslegeschrift No. 2,711,958, alone or mixed with water, there is very little risk of soiling of the pipeline of the pneumatic conveyor device.

The apparatus for carrying out the process generally consists of a pneumatic transport device with conveyor blower, feed screw, pipelines, separators, compensating vessel and knife gate and is characterized by the fact that one or more nozzles for spraying the bonding agent is or are arranged in one or more sections of the pipes of the transport device.

These nozzles are mounted at the end of feed tubes for bonding agent, which penetrate the pipe from outside and end more or less centrally in the axis of the pipeline.

The conveyor blower used in a medium pressure blower operating at an air pressure of from about 0.2 to 0.8 bar in order that a high density of material may be obtained round the nozzles in the pipeline, which is most suitable for application of the bonding agent. More than one nozzle may be provided for spraying bonding agent. These should be situated at least about 1 meter apart and arranged in succession in the pipe of the transport device so that the bonding agent is applied stepwise. Exceptionally homogeneous distribution is thereby achieved.

FIG. 1 shows the apparatus with the main parts of a pneumatic transport device for wood chips. Air is sucked in through a filter 1 by a conveyor blower 2 and forced into the pipeline 3. The pipeline 3 may be constructed quite differently according to local requirements and may consist of individual pipes 5 connected by flanges 4. Only the essential parts of the pneumatic conveyor device are shown. Connected downstream of the blower 2 and close to it is a feed device 6 with gate for introducing the wood chips into the pneumatic conveyor device. One or more inspection windows 7 may be fitted into the pipeline 3 so that the air stream carrying the chips dispersed into a film of particles may be observed from outside.

Figure 2:
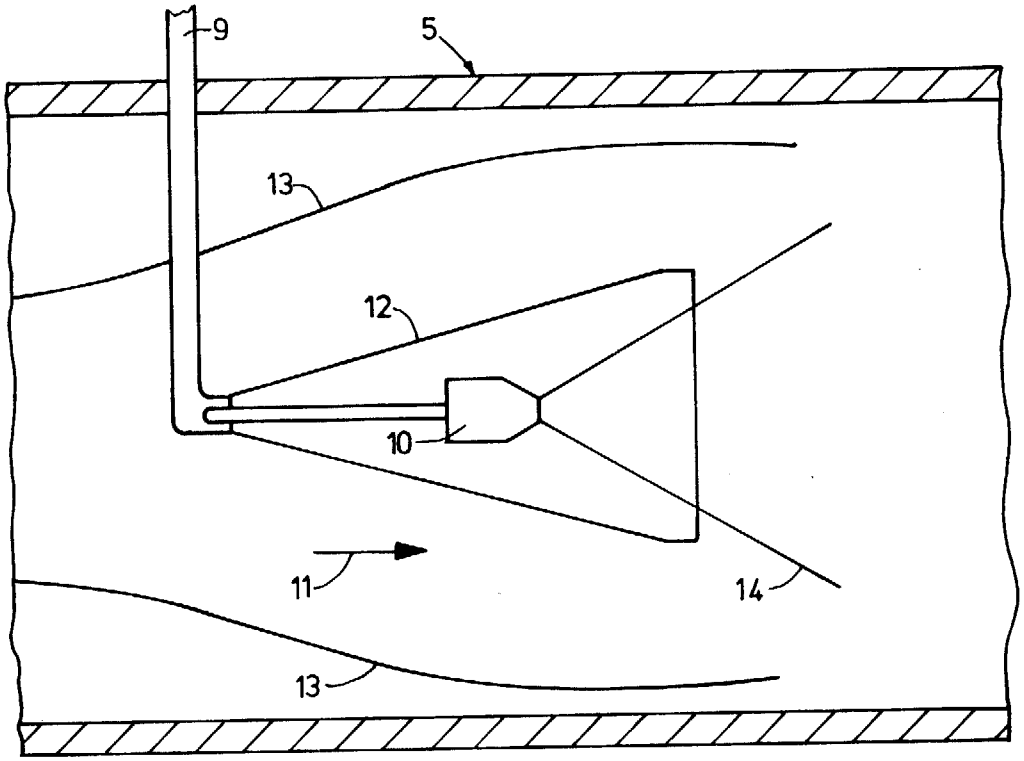
FIG. 2 is a section through the pipe with nozzle.

The device for supplying bonding agent is provided in a suitable position on a pipe 5 of the pipeline 3 or it may be distributed over several pipes, with the various units thereof arranged successively. A pump 8 serves to apply a liquid pressure of about 200 bar to the liquid bonding agent. A tube 9 passing through the wall of the pipe 5 ends in a nozzle 10 from which the bonding agent is sprayed. As may be seen in FIG. 2, the nozzle 10 is situated substantially in the axis of the pipe 5 and points in the direction of movement of the stream of chips as indicated by arrow 11. The nozzle 10 and end of the tube 9 are surrounded by the funnel or cone-shaped air conducting installations 12 which keep the outlet end of the nozzle 10 free from chips. The dispersed film of particles of wood chips widens out at this point so that flow lines 13 are produced. This causes a pressure cone 14 to build up downstream of the nozzle 10. In this pressure cone the bonding agent has the opportunity to mix with air and thus be finely divided over a larger volume of air before it enters into contact with the film of particles.

Several nozzles 10 may be arranged axially successively in the pipe 5 or pipeline 3 with a minimum distance of 1 meter therebetween. This arrangement enables the application of bonding agent to be increased stepwise and particularly homogeneous distribution of the bonding agent over the film of wood chips is achieved.

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

EXAMPLE

The equipment illustrated in the figure is used. The conveyor blower 2 is operated with a pressure of 0.25 bar and produces an air stream of 4350 $m^3/h$ which is conducted via pipeline 3. By means of the feed device 6, 12 t/h of wood chips are fed into the air stream. They distribute themselves evenly in the air stream before this mixture flows past two nozzles 10 for bonding agent arranged in the pipeline 3. By means of these nozzles 10, 600 kg/h of isocyanate is sprayed (into the pipeline) at an injection pressure of 120 bars and adheres to the surface of the wood chips. The wood chips consist of comminuted pinewood having an average chip size of $20\times2\times0.5$ $mm^2$ and a bulk density of 0.11 $kg/dm^3$. The isocyanate has the following composition:

about 55% 4,4'-diphenylmethane-diisocyanate
about 5% 2,4'-diphenylmethane-diisocyanate
about 40% several structural compounds, characterized by the general formula:

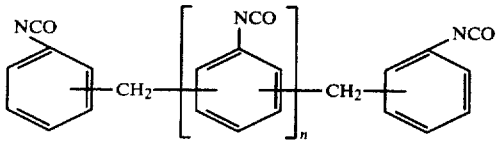

(n = 1 and 2)

viscosity at 25° C.: about 200 m Pas
isocyanate-content: about 30,5%.

What is claimed is:

1. In a process for bonding particulate material by the spraying of bonding agent onto the material which material is in the form of a film of particles, the improvement wherein (i) said particulate material is fed into a pneumatic material transport device at a first location,
(ii) said film of particles is uniformly diverted by at least one air conducting installation located within said pneumatic material transport device downstream of said first location, and
(iii) bonding agent is sprayed onto said material within said pneumatic material transport device downstream of said air conducting installation, whereby said bonding agent is dispersed in air before it comes into contact with said material.

2. The process according to claim 1, characterized in that a medium pressure system using an air pressure of from 0.2 to 0.8 bar is used for the pneumatic conveyance of material.

3. The process according to claim 1, characterized in that the application of bonding agent is carried out via several spaced nozzles.

4. The process according to claim 1, characterized in that the bonding agent used is a polyisocyanate mixture of the diphenylmethane series.

5. An apparatus comprising a pneumatic material transport device comprising a conveyor blower, feed device, pipelines, separator, equalizing vessel and knife gate, characterized in that (i) at least one spray nozzle for bonding agent is arranged in at least one section of the pipe of the material transport device downstream of said feed device, and (ii) air conducting installations are attached to each spray nozzle.

6. The apparatus according to claim 5, characterized in that the conveyor blower consists of a medium pressure blower for from about 0.2 to 0.8 bar air pressure.

7. The apparatus according to claim 5, characterized in that spray nozzles for bonding agent are arranged in succession at a minimum distance of about 1 meter in the pipe of the material transport device.

* * * * *